US010431395B2

(12) United States Patent
Lin et al.

(10) Patent No.: US 10,431,395 B2
(45) Date of Patent: Oct. 1, 2019

(54) MULTI-FUNCTION CONTROLLER AND MOBILE DEVICE HAVING SAME

(71) Applicant: HON HAI PRECISION INDUSTRY CO., LTD., New Taipei (TW)

(72) Inventors: Ying-Tsen Lin, New Taipei (TW); Chi-Wen Chiang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/858,409

(22) Filed: Dec. 29, 2017

(65) Prior Publication Data

US 2019/0115165 A1 Apr. 18, 2019

(30) Foreign Application Priority Data

Oct. 18, 2017 (TW) ..... 106135786

(51) Int. Cl.

*H01H 3/08* (2006.01)
*H04R 3/00* (2006.01)
*H01H 3/12* (2006.01)

(52) U.S. Cl.

CPC ..... *H01H 3/08* (2013.01); *H01H 3/12* (2013.01); *H04R 3/00* (2013.01); *H01H 2221/01* (2013.01)

(58) Field of Classification Search

CPC .... H01H 3/125; H01H 13/14; H01H 13/7065; H01H 3/12; H01H 3/122; H01H 13/70; H01H 2215/006; H01H 2221/01; H01H 3/08; H01H 19/14; H01H 25/06; H01H 25/008; H04M 1/6058; H04M 1/72527; H04M 1/0258; H04M 1/21; H04M 1/05

See application file for complete search history.

(56) References Cited

U.S. PATENT DOCUMENTS 8,532,585 B2 9/2013 Deleus et al.
8,611,564 B1 * 12/2013 Yen ..... H01R 13/7175 381/124
2005/0230233 A1 * 10/2005 Hoehne ..... H01H 13/023 200/314
2008/0041709 A1 * 2/2008 Koizumi ..... B60K 37/06 200/5 R

FOREIGN PATENT DOCUMENTS

TW M291597 6/2006

* cited by examiner

*Primary Examiner* — Ahmed M Saeed
(74) *Attorney, Agent, or Firm* — ScienBiziP, P.C.

(57) ABSTRACT

A single device operable as a controller with multiple functions includes a mounting member, a control member, a first switch, a second switch, a third switch, and a processing unit. The control member can be pressed and rotated with respect to the mounting member. The first switch, the second switch, and the third switch are located on the mounting member. The processing unit is electrically connected to all the switches. The processing unit receives a first control signal from the first switch when the control member is pressed, a second control signal from the second switch when the control member is rotated clockwise, and a third control signal from the third switch when the control member is rotated counterclockwise.

18 Claims, 6 Drawing Sheets

MULTI-FUNCTION CONTROLLER AND MOBILE DEVICE HAVING SAME

CROSS REFERENCE TO RELATED APPLICATION

This application claims priority to Taiwan Patent Application No. 106135786, filed Oct. 18, 2017, the disclosure of which is incorporated herein by reference in its entirety.

FIELD

The present disclosure relates to controlling mobile devices, and more particularly to a multi-function controller for a mobile device.

BACKGROUND

A mobile device such as a smartphone or tablet includes a plurality of physical buttons for different functions. For example, a power button is for turning on and off the mobile device, a volume up button is for increasing the volume, and a volume down button is for decreasing the volume. However, a user's finger must move to different locations to control the different buttons, causing operational inconvenience. In addition, the plurality of buttons have a plurality of components, causing difficulties in manufacturing and assembling the mobile device.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
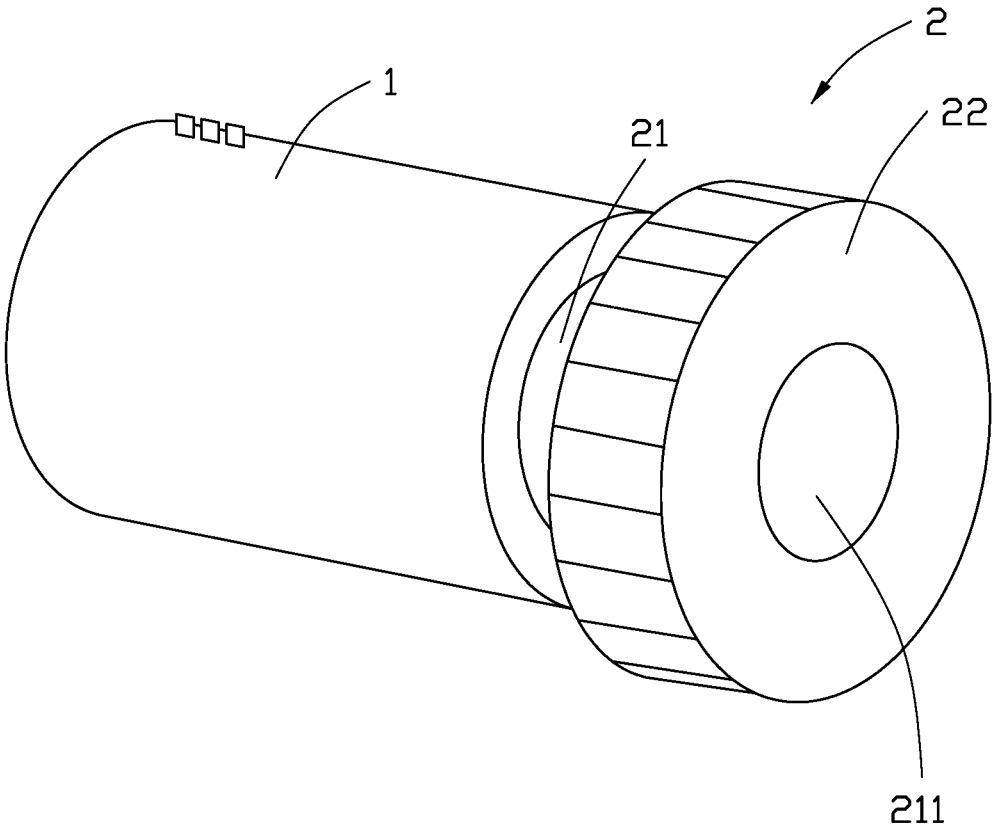
FIG. 1 is a schematic perspective view of a mounting member and a control member of a multi-function controller according to an exemplary embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

Figure 2:
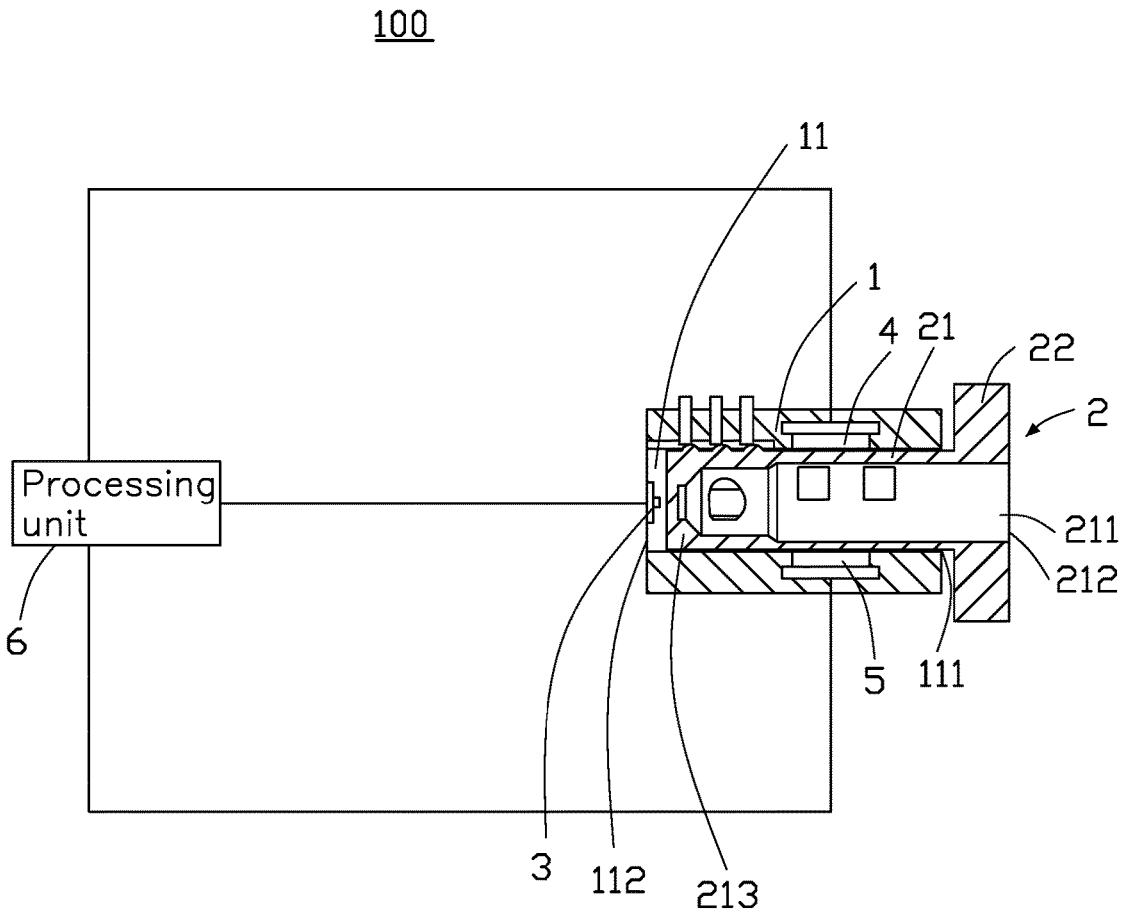
FIG. 2 is a schematic front view in partial section of the multi-function controller of FIG. 1.

With reference to FIGS. 1 and 2, an exemplary embodiment of a multi-function controller 100 includes a mounting member 1, a control member 2, a first switch 3, a second switch 4, a third switch 5, and a processing unit 6.

The mounting member 1 is a tube having a receiving hole 11, an outer end 111, and an inner end 112.

The control member 2 can be pressed and rotated with respect to the mounting member 1. The pressing stroke of the control member 2 is approximately 0.5 mm. The control member 2 includes a control tube 21 and a control ring 22. The control tube 21 is received in the receiving hole 11 of the mounting member 1. The control tube 21 includes a conventional audio jack 211, an open end 212, and a closed end 213. The audio jack 211 has a conventional diameter of 3.5 mm, and is not described in detail herein. The control ring 22 extends from the open end 212 of the control tube 21. The control ring 22 protrudes out of the outer end 111 of the mounting member 1.

The first switch 3 is located on the inner end 112 of the mounting member 1. The first switch 3 responds to the control member 2 being pressed. The first switch 3 is preferably a microswitch.

The second switch 4 and the third switch 5 are spaced apart on opposite portions of a peripheral wall of the mounting member 1. The second switch 4 and the third switch 5 respond to the control member 2 being rotated clockwise and being rotated counterclockwise, respectively. The second switch 4 and the third switch 5 are preferably magnetic induction switches.

The processing unit 6 is electrically connected to the first switch 3, the second switch 4, and the third switch 5. The processing unit 6 receives a first control signal from the first switch 3 when the control member 2 is pressed. The processing unit 6 receives a second control signal from the second switch 4 when the control member 2 is rotated clockwise. The processing unit 6 receives a third control signal from the third switch 5 when the control member 2 is rotated counterclockwise.

Figure 3:
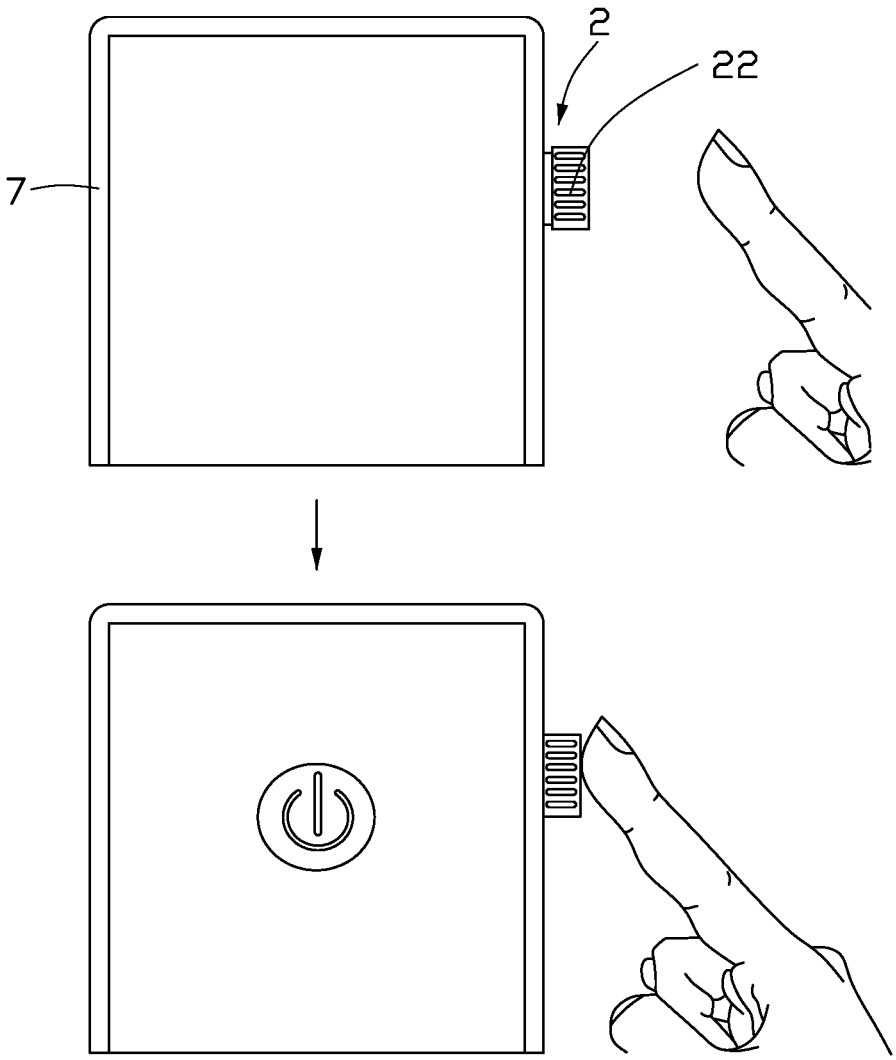
FIG. 3 is an operational front view of the multi-function controller of FIG. 1 within a body of a mobile device, showing the control member being pressed.
Figure 4:
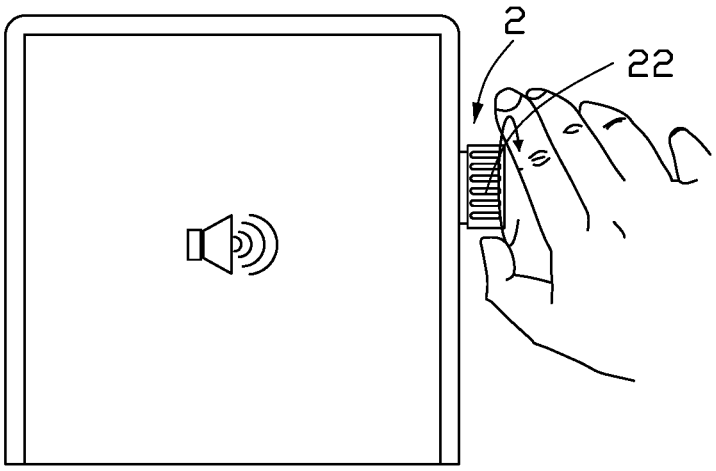
FIG. 4 is an operational front view of the multi-function controller of FIG. 1 within the body of the mobile device, showing the control member being rotated clockwise.
Figure 5:
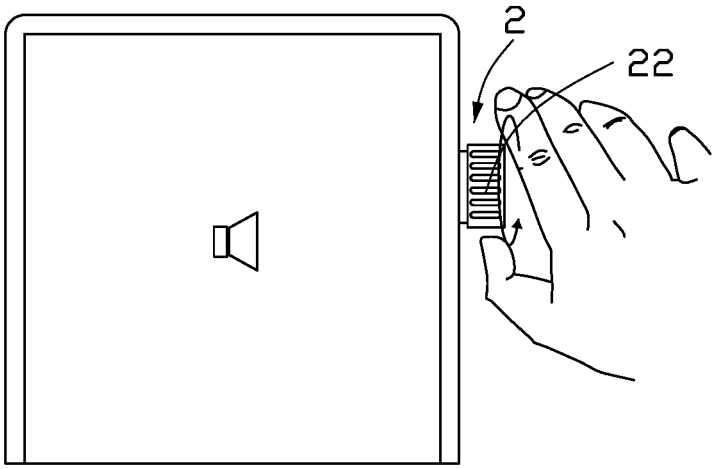
FIG. 5 is an operational front view of the multi-function controller of FIG. 1 within the body of the mobile device, showing the control member being rotated counterclockwise.
Figure 6:
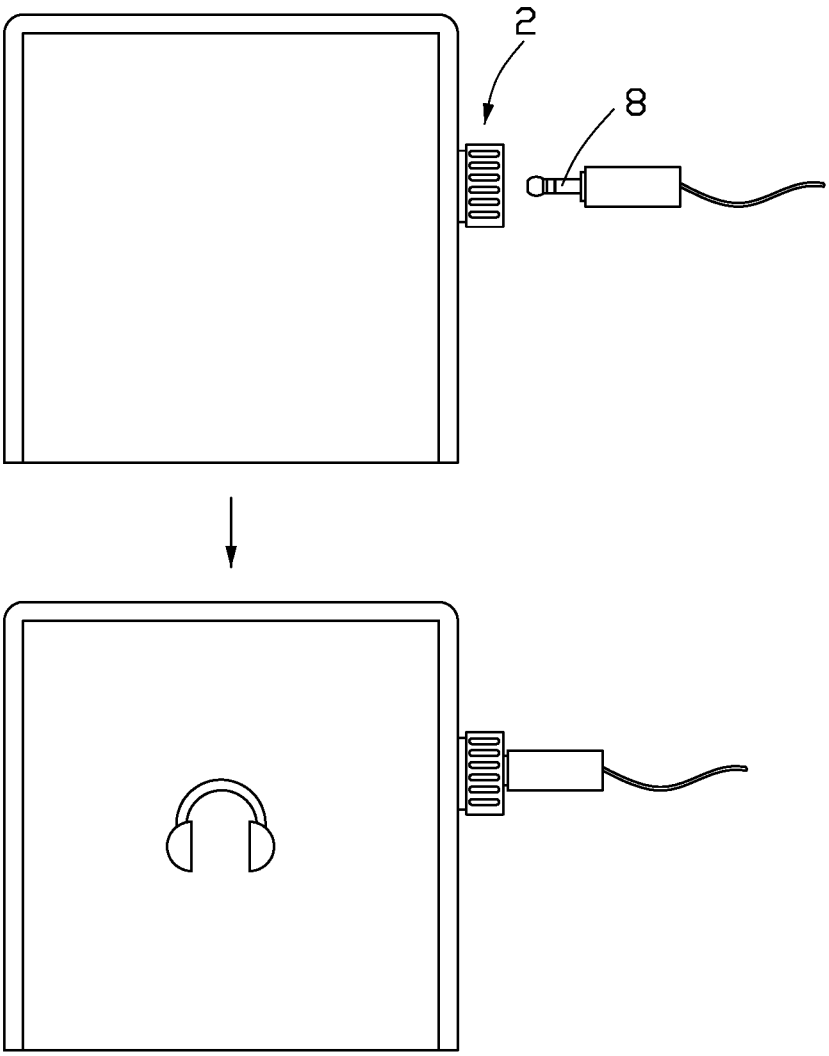
FIG. 6 is an operational front view of the multi-function controller of FIG. 1 within the body of the mobile device, showing an audio plug inserted into the control member.

The multi-function controller 100 allows a user to control different functions by operating the single control member 2. With reference to FIGS. 2 and 3, in use, the multi-function controller 100 is disposed in a body 7 of a mobile device. The mounting member 1, the control tube 21 of the control member 2, the first switch 3, the second switch 4, the third switch 5, and the processing unit 6 are disposed inside the body 7 of the mobile device, and the control ring 22 of the control member 2 protrudes out of the body 7 of the mobile device. With reference to FIG. 3, the processing unit 6 receives the first control signal from the first switch 3 to turn on the mobile device when the user presses the control ring 22 of the control member 2. With reference to FIG. 4, the processing unit 6 receives the second control signal from the second switch 4 to increase the volume of the mobile device when the user rotates the control ring 22 of the control member 2 clockwise. With reference to FIG. 5, the processing unit 6 receives the third control signal from the third switch 5 to decrease the volume of the mobile device when the user rotates the control ring 22 of the control member 2 counterclockwise. With reference to FIG. 6, the mobile device outputs audio when the user inserts an audio plug 8 into the audio jack 211 of the control tube 21 of the control member 2.

The exemplary embodiments shown and described above are only examples. Many details are often found in the art such as the other features of a mobile device controller. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. A multi-function controller comprising:

a mounting member having a receiving hole defined therein;

a control member partially received in the receiving hole of the mounting member, and being capable of being pressed and rotated with respect to the mounting member;

a first switch located at an end of the mounting member;

a second switch disposed at a peripheral wall of the mounting member, a third switch located spaced from the second switch and at the peripheral wall of the mounting member; and a processing unit, the processing unit being electrically connected to the first switch, the second switch, and the third switch;

wherein the processing unit is configured for selectively receiving a first control signal from the first switch when the control member is pressed, receiving a second control signal from the second switch when the control member is rotated clockwise, or receiving a third control signal from the third switch when the control member is rotated counterclockwise, wherein the control member comprises a control tube received in the receiving hole of the mounting member and a control ring, the control tube comprises a conventional audio jack, an open end and a closed end, the control ring extends from the open end of the control tube.

2. The multi-function controller of claim 1, wherein the mounting member is a tube having the receiving hole, an outer end, and an inner end, the control ring protrudes out of the outer end of the mounting member.

3. The multi-function controller of claim 2, wherein the first switch is located on the inner end of the mounting member.

4. The multi-function controller of claim 2, wherein the second switch and the third switch are spaced apart on opposite portions of the peripheral wall of the mounting member.

5. The multi-function controller of claim 3, wherein the second switch and the third switch are spaced apart on opposite portions of the peripheral wall of the mounting member.

6. The multi-function controller of claim 1, wherein the first switch is a microswitch.

7. The multi-function controller of claim 5, wherein the first switch is a microswitch.

8. The multi-function controller of claim 1, wherein the second switch and the third switch are magnetic induction switches.

9. The multi-function controller of claim 5, wherein the second switch and the third switch are magnetic induction switches.

10. A mobile device, comprising:

a body; and a multi-function controller disposed in the body, and comprising:

a mounting member having a receiving hole defined therein;

a control member partially received in the receiving hole of the mounting member, and being capable of being pressed and rotated with respect to the mounting member;

a first switch located at an end of the mounting member;

a second switch disposed at a peripheral wall of the mounting member, a third switch located spaced from the second switch and at the peripheral wall of the mounting member; and a processing unit, the processing unit being electrically connected to the first switch, the second switch, and the third switch;

wherein the processing unit is configured for selectively receiving a first control signal from the first switch when the control member is pressed, receiving a second control signal from the second switch when the control member is rotated clockwise, or receiving a third control signal from the third switch when the control member is rotated counterclockwise, wherein the control member comprises a control tube received in the receiving hole of the mounting member and a control ring, the control tube comprises a conventional audio jack, an open end and a closed end, the control ring extends from the open end of the control tube.

11. The mobile device of claim 10, wherein the mounting member is a tube having the receiving hole, an outer end, and an inner end; the control ring protrudes out of the outer end of the mounting member.

12. The mobile device of claim 11, wherein the first switch is located on the inner end of the mounting member.

13. The mobile device of claim 11, wherein the second switch and the third switch are spaced apart on opposite portions of the peripheral wall of the mounting member.

14. The mobile device of claim 12, wherein the second switch and the third switch are spaced apart on opposite portions of the peripheral wall of the mounting member.

15. The mobile device of claim 10, wherein the first switch is a microswitch.

16. The mobile device of claim 14, wherein the first switch is a microswitch.

17. The mobile device of claim 10, wherein the second switch and the third switch are magnetic induction switches.

18. The mobile device of claim 14, wherein the second switch and the third switch are magnetic induction switches.

* * * * *